United States Patent [19]

Packendorff

[11] Patent Number: 4,566,157

[45] Date of Patent: Jan. 28, 1986

[54] CLIP WITH SLIDING LOCKING MEMBER

[76] Inventor: Sven E. Packendorff, Näckrosvägen 7, S-445 00 Surte, Sweden

[21] Appl. No.: 622,791

[22] Filed: Jun. 21, 1984

[30] Foreign Application Priority Data

Jun. 23, 1983 [SE] Sweden ..... 8303624

[51] Int. Cl.[4] ..... A44B 21/00

[52] U.S. Cl. ..... 24/536; 24/537; 24/542; 24/543; 24/545

[58] Field of Search ..... 24/536, 537, 542, 543, 24/544, 545, 490, 346

[56] References Cited

U.S. PATENT DOCUMENTS

| | | | |
|---|---|---|---|
| 113,313 | 4/1871 | Lipsey | 24/537 |
| 763,793 | 6/1904 | Pickert | 24/536 |
| 1,477,256 | 12/1923 | Fritz | 24/545 |
| 2,337,723 | 12/1943 | Levin | 24/536 |
| 2,540,237 | 2/1951 | Bevin, II | 24/537 |
| 2,542,224 | 2/1951 | Werner | 24/536 |
| 2,618,034 | 11/1952 | Rinne | 24/543 |
| 3,100,324 | 8/1963 | Tutino et al. | 24/542 |
| 3,924,303 | 12/1975 | Elliott | 24/536 |
| 4,082,094 | 4/1978 | Dailey | 24/536 |
| 4,337,774 | 7/1982 | Perlin | 24/536 |

FOREIGN PATENT DOCUMENTS

| | | |
|---|---|---|
| 363152 | 11/1922 | Fed. Rep. of Germany . |
| 2603035 | 8/1977 | Fed. Rep. of Germany . |
| 907620 | 3/1946 | France . |
| 133689 | 11/1951 | Sweden . |
| 145423 | 2/1931 | Switzerland . |
| 623796 | 5/1949 | United Kingdom ..... 24/537 |

*Primary Examiner*—Victor N. Sakran

*Attorney, Agent, or Firm*—Merchant, Gould, Smith, Edell, Welter & Schmidt

[57] ABSTRACT

A U-shaped clip for clothes or the like has a web and two resilient legs between which the clothes or the like can be placed. On at least one leg there is a bevel to facilitate attachment and detachment of a preferably substantially E-shaped locking member which is slidable along the legs for clamping the legs to the clothes or the like. The outer sides of the legs and preferably also the inner sides of the locking member have a friction increasing surface structure.

5 Claims, 7 Drawing Figures

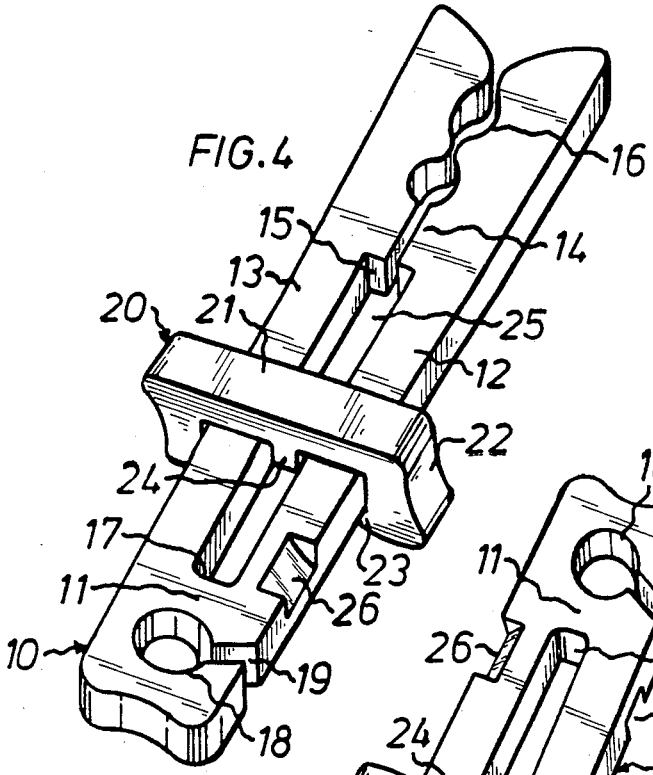
FIG. 4
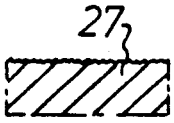
FIG. 5
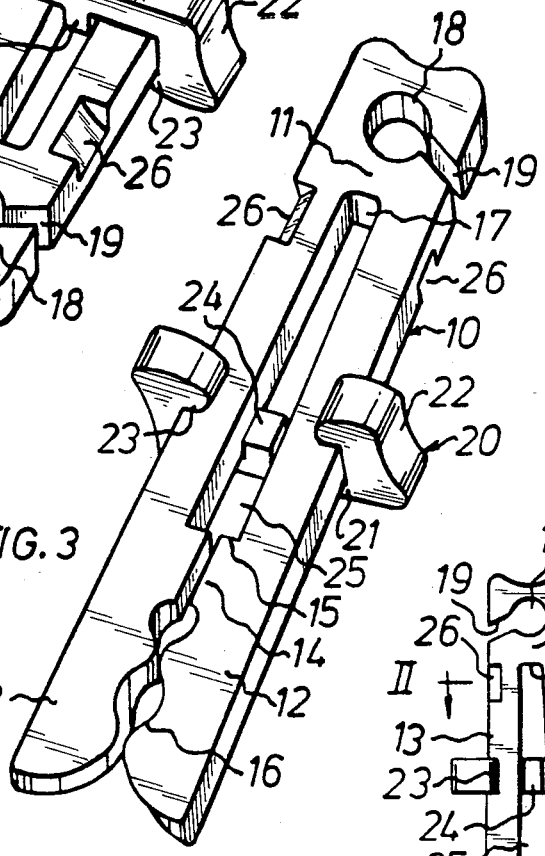
FIG. 3
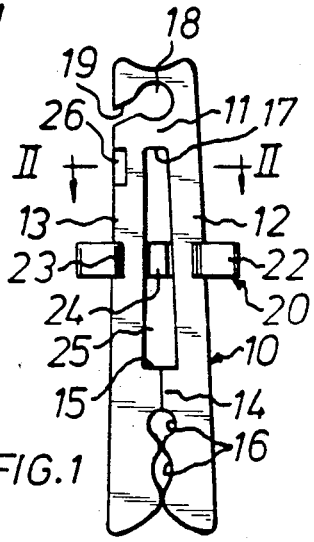
FIG. 1
FIG. 2
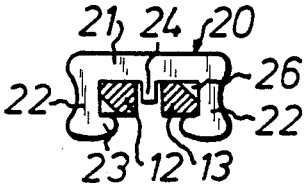

FIG. 7
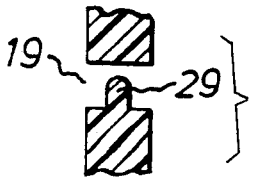
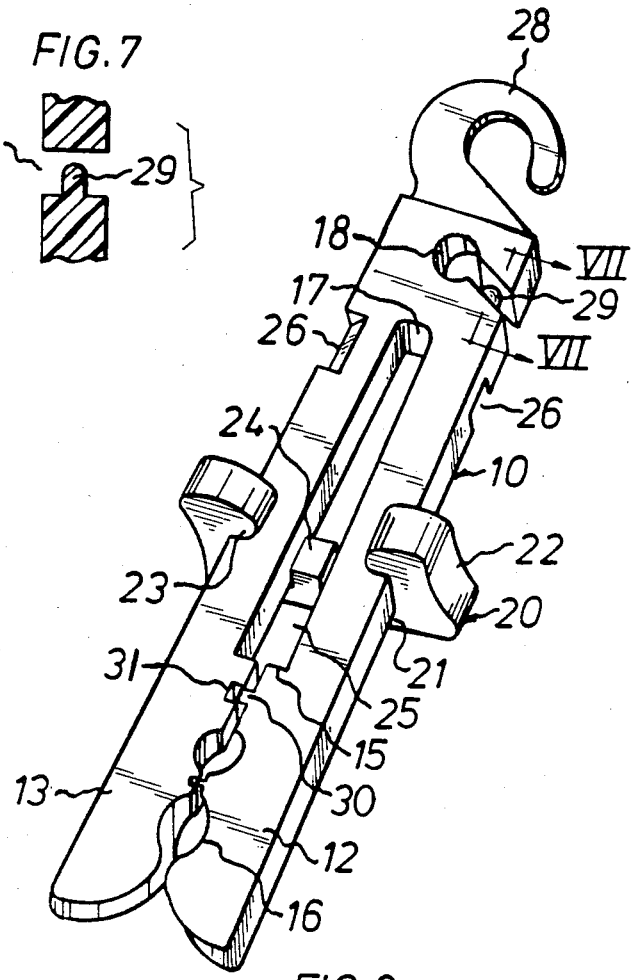
FIG. 6

CLIP WITH SLIDING LOCKING MEMBER

The present invention relates to a clip or clothespin of the general type as disclosed in, for example, U.S. Pat. No. 3,100,324 and SE-B-133,689. Similar clips are also described in U.S. Pat. Nos. 2,540,237, 2,618,034 and 3,924,303.

All known clips of this general type are substantially U-shaped with a web and two legs which are interconnected by said web, and between which legs clothes or the like are placed, the clips furthermore having a locking member slidable along the legs for clamping the legs to the clothes. The prior art clips are, however, not adapted to simple and rational series production allowing the parts to be supplied in unassembled state to the customer who then mounts the locking member on the main portion of the clip. The same applies to the clip described and shown in FR-A-907,620, DE-Al-2,603,035 and CH-A-145,423. The clip disclosed in FR-A-907,620 is, besides, disadvantageous since the slidable locking member can easily slide off the ends of the legs and thus be lost, and furthermore, with this construction it is not possible to obtain such a strong clamping of the clothes or the like as could be desired. Thus, the clip of the last-mentioned patent has the same disadvantages as the clip according to the abovementioned U.S. Pat. No. 2,540,237.

SE-B-133,689 describes a clothespin of metal where the spring action is enhanced by a clamp or lock-ring, but this construction has the same disadvantages as for example U.S. Pat. No. 3,100,324.

CH-A-145,423 discloses a design where no direct spring action of the material of the legs is utilized. If this had been the case, the design shown in the patent specification would not have been chosen.

DE-Al-2,603,035 discloses another conventional clip where the spring action proper is provided by means of a U-spring while a positive locking effect is provided by a displaceable slide or the sleeve.

One object of the present invention therefore is to eliminate the disadvantages of the prior art clips. A further object of the invention is to provide a clip which may be manufactured by two simple tools for delivery of the clip in two parts to the customers. One more object of the invention is to provide a clip having a locking member which is easily detachable and attachable. It is also an object of the invention to provide a clip, the locking member of which is slidable along the legs of the clip but prevented from accidentally sliding off the legs of the clip.

Thus the invention relates to a clip which is substantially U-shaped and has a web and two legs which are interconnected by said web and between which clothes or the like can be placed, said clip furthermore having a locking member slidable along the legs for clamping the legs to the clothes or the like. According to the present invention this clip is characterised in that the locking member is detachable from and attachable to the two legs and is substantially E-shaped, the intermediate cross-bar or center pin of the E-section being adapted to intrude into a space formed between the legs and being in this space slidable between two end positions determined by abutment surfaces.

By designing the clip according to the invention in the manner stated in the main claim, thus providing it with a substantially E-shaped locking member and with a space between the legs, which space has abutment surfaces at each end, and by designing the E-shaped locking member to be detachable from and attachable to the two legs, it is possible to obtain all the useful advantages which make the clip superior to prior art products and, furthermore, saleable, such that the consumer obtains all the properties wanted, i.e. a clip which is easily mountable (delivered in unassembled state), has an excellent clamping force (by the resilient deformation of the legs when the locking member is displaced) and maintains its properties (because the locking member cannot slide off the legs and fall out). Since the slot or space formed between the legs is delimited by the abutment surfaces at the ends, it is possible to better use the resiliency of the clip material, thus obtaining a better clamping effect. By cooperation between the intermediate cross-bar of the E-shaped locking member and this slot or space, the loss of the locking member is prevented and clear end positions for the movement of this member along the clip are provided.

In a preferred embodiment of the invention, the legs and preferably also the inner sides of the locking member are designed with a friction increasing surface structure such that it is possible to maintain enough friction between the legs and the locking member in order to keep the locking member in a locking position.

To increase the clamping force, it is in one embodiment of the invention especially advantageous to increase the width of at least one of the legs in the direction towards its free end such that the legs will be exposed to a bending force when clamping the clothes to a clothesline or the like.

To enable a simple and safe attachment of the locking member, the clip has preferably at least one bevel formed on the outer side of at least one leg and preferably close to the web and facilitating the attachment and detachment of the substantially E-shaped locking member to and from the legs.

Two embodiments according to the invention will be described in detail below, reference being had to the accompanying drawings in which:

FIG. 1 is a lateral view of an embodiment of a clip according to the invention.

FIG. 2 is a section along line II—II in FIG. 1,

FIGS. 3 and 4 show the clip in perspective views from two opposite sides, FIG. 5 is a much enlarged view of a portion of the surface of the clip and/or the locking member, FIG. 6 is a perspective view of a further embodiment of a clip according to the invention; and FIG. 7 is a section along line VII—VII in FIG. 6.

As appears from FIG. 1, the clip 10 is substantially U-shaped with a web 11 and two legs 12, 13. At the free ends of the legs there is a thickened portion 14 forming an abutment surface 15 on each leg. The thickened portion 14 has two recesses 16 corresponding to the recesses on normal clips or clothespins. The inner side of the web 11 forms another abutment surface 17. In the web there is a recess 18 with a groove 19 through which a clothesline or the like can be inserted such that the clip 10 can be hung on a line and remain pendent also when clothes or the like are clamped.

The clip has a locking member 20 which according to the invention is detachable from and attachable to the clip 10. This locking member 20 has according to the invention substantially an E-section, the upright bar 21 of which is extending across the legs 12, 13, whereas the top and bottom cross-bars 22 are extending exteriorly of the legs 12 and 13 and are seizing them by means of a hook portion 23. The intermediate crossbar or the center pin 24 of the E-section projects between the legs 12 and 13 and can thus move back and forth in a space 25 delimited by the abutment surfaces 15 and 17 and the inner sides of the two legs 12, 13. In order to enable easy attachment and detachment of the E-shaped locking member, the legs 12, 13 are designed with a bevel 26 close to the web 11. Bevel 26 extends into the surface of the leg toward an adjacent edge and in a preferred embodiment bevels 26 are located on opposite surfaces of opposite legs. The embodiment shown comprises two such bevels 26 which are diagonally disposed relative to one another. The bevels or bevel 26 has such a depth that the E-shaped locking member 20 has to be slightly, resiliently deformed outwardly to enable the locking hook 23 to slide over the adjacent leg 12 or 13.

With the presence of the intermediate cross-bar or center pin 24 the locking member 20 is guided such that it cannot slide off the free end of the legs or off the web 11 and, furthermore, is kept substantially perpendicular to said legs.

As appears from FIG. 1 and also the perspective views in FIGS. 3 and 4, the clip 10 is somewhat narrower at its web end than at its leg end. By this slight taper, the cross-bars 22 of the locking member will exert an increasing pressing force against the legs 12, 13 the closer it comes to the free end of the legs. The distance between the inner sides of the cross-bars 22 is substantially the same as the distance between the outer sides of the legs 12, 13 about half-way between the abutment surfaces 15 and 17.

The clip according to the invention is preferably manufactured from a resilient but still rather rigid plastic material, thus enabling the legs to function as powerful springs. To increase the friction between the locking member 20 and the clip 10, the clip surface and preferably also the locking member surfaces facing each other may be rough as shown by the rough surface 27 in FIG. 5.

The clip according to FIGS. 6 and 7 differs from the clip in FIGS. 1–5 mainly in three respects. Thus, the clip in FIG. 6 has a suspension hook 28 outside the hook formed by the recesses 18 and 19, the hook 28 being adapted to thicker suspension cords. Furthermore a protrusion 29 has been formed in the groove 19 such that a suspension cord or line must be deformed when inserting it into or removing it from the recess 18 through the groove 19. This feature substantially decreases the risk for unintentional loosening of the clip from its suspension cord or line. Finally, the legs 12, 13 are provided with interacting protrusion and recess portions 30 and 31, respectively, to prevent unintentional pressing of the clip so far down over the suspension line that this enters the space 25.

What I claim and desire to secure by Letters Patent is:

1. A substantially U-shaped clip having a web and two legs having upper and lower surfaces and edges, said legs protruding from the web, between which legs clothes or the like are placed, and furthermore having a locking member slidable along the legs and extending across the legs for clamping the legs to the clothes or the like, characterised in that the locking member is detachable from and attachable to the two legs and is substantially E-shaped, the intermediate cross-bar of the center pin of the E-section being adapted to project into a space formed between the legs and being slidable in this space between two end positions determined by abutment surfaces, said two legs each including a beveled portion extending from the upper surface on one leg toward an adjacent edge and from the lower surface on the other leg towards its adjacent edge to provide a locating at which said locking member may be installed on and removed from said legs.

2. A clip according to claim 1 wherein said beveled portions are located on said legs adjacent said web.

3. A clip according to claim 1 wherein the edge of said legs include opposing interactive surfaces silzed to engage each other on closure of the clip.

4. A clip according to claim 3 wherein said interactive surfaces include at least one land on one leg and at least one mating recess on the other leg.

5. A substantially U-shaped clip having a web and two legs having upper and lower surfaces and edges, said legs protruding from the web, between which legs clothes or the like are placed, and furthermore having a locking member slidable along the legs and extending across the legs for clamping the legs to the clothes or the like, characterised in that the locking member is detachable from and attachable to the two legs and is substantially E-shaped, the intermediate cross-bar of the center pin of the E-section being adapted to project into a space formed between the legs and being slidable in this space between two end positions determined by abutment surfaces, one of said legs including a beveled portion extending from the upper surface toward its adjacent edge to provide a location at which said locking member may be installed on and removed from said legs.

* * * * *